United States Patent [19]

Russell, Jr.

[11] Patent Number: 4,844,171

[45] Date of Patent: Jul. 4, 1989

[54] ADAPTER

[76] Inventor: William G. Russell, Jr., 2519 4th St., Woodward, Okla. 73801

[21] Appl. No.: 171,894

[22] Filed: Mar. 22, 1988

[51] Int. Cl.[4] ..... E21B 19/16

[52] U.S. Cl. ..... 166/377; 81/57.26; 166/77.5; 166/78; 166/85; 166/379; 166/380

[58] Field of Search ..... 166/377, 379, 380, 76, 166/77.5, 78, 85; 175/423; 173/164; 81/54, 57.15, 57.16, 57.33, 180, 185, 185.1, DIG. 11; 294/91

[56] References Cited

U.S. PATENT DOCUMENTS

| | | | |
|---|---|---|---|
| 1,473,684 | 11/1923 | Rose | 294/91 |
| 1,541,986 | 6/1925 | Martin | 294/91 |
| 1,648,650 | 11/1927 | Lynch | 294/91 |
| 1,798,296 | 3/1931 | Yerkes et al. | 294/91 |
| 2,153,474 | 4/1939 | Naylor et al. | 294/91 X |
| 2,295,720 | 9/1942 | Dietzmann et al. | 166/77.5 |
| 2,300,370 | 10/1942 | Lowery | 294/91 |
| 2,967,446 | 1/1961 | Martois | 81/57.16 |
| 3,434,191 | 3/1969 | Timmons | 166/77.5 X |
| 4,348,920 | 9/1982 | Boyadjieff | 166/77.5 X |
| 4,483,564 | 11/1984 | McDaniel | 166/77.5 X |

FOREIGN PATENT DOCUMENTS

| | | | |
|---|---|---|---|
| 3523221 | 1/1987 | Fed. Rep. of Germany | 166/380 |
| 781316 | 11/1980 | U.S.S.R. | 173/164 |

*Primary Examiner*—Hoang C. Dang

*Attorney, Agent, or Firm*—Laney, Dougherty, Hessin & Beavers

[57] ABSTRACT

An adapter which can be used to enable a sucker rod to be rotated by tubing tongs includes a rod-mountable assembly comprising a sleeve in which the rod to be rotated is received, and a door which is mounted on the sleeve to rotate between an open position, wherein the rod can be received in the sleeve, and a closed position, wherein the rod-mountable assembly is held on the rod. Included in a preferred embodiment is a holding assembly adapted to be connected to the tubing tongs to hold a lower rod against rotation. A method of rotating a rod relative to a string of rods used in a well is also disclosed.

17 Claims, 2 Drawing Sheets

ADAPTER

BACKGROUND OF THE INVENTION

This invention relates generally to an adapter which can be used on a rod and more particularly, but not by way of limitation, to an adapter which enables a rod used in a well to be rotated by tubing tongs. The invention also relates to a method of rotating a rod relative to a string of one or more rods used in a well.

In testing and completing an oil well, for example, it is well known that a tubing string can be used in such jobs as logging, perforating and flowing the well. A tubing string comprises individual tubular members which are connected together at joints in end-to-end manner. Each joint is typically a threaded coupling wherein one end of one tubular member is screwed in an end of another tubular member. The screwing, or rotating, action by which one tubular member is connected to or disconnected from another tubular member is imparted by means of tubing tongs, a known type of equipment which is commonly found at a site where a well is being drilled or completed or which is otherwise readily available in the oil and gas industry.

In producing an oil well, for example, it is well known that a string of rods, sometimes referred to as sucker rods, is sometimes needed to pump oil up from a subterranean formation intersected by the well. The rods are connected end-to-end at joints which typically include threaded coupling collars. Typically, adjacent ends of adjacent rods have the same configurations which include threaded pin ends. These ends are screwed into opposite ends of a coupling collar to form the joint between the two adjacent rods. Thus, as with the aforementioned tubular members, to connect or disconnect one rod to or from another rod, one of the rods needs to be rotated relative to the other.

Because rods have smaller diameters than tubular members, however, this rotating could not heretofore be accomplished with the prevalent tubing tongs. Instead, apparatus known as rod tongs have been required to connect and disconnect rods; however, rod tongs have not been as prevalent as tubing tongs so that when one needs to connect or disconnect rods, there may be a delay in obtaining the relatively scarce rod tongs and it may also be more expensive to use rod tongs instead of tubing tongs (for example, because of additional costs or lost revenues brought about by a delay in obtaining the rod tongs and because of higher fees which may be charged to provide the relatively scarce rod tongs).

In view of the prevalence of tubing tongs compared to rod tongs, it would be desirable, to overcome the deficiencies noted above, to be able to use tubing tongs to rotate rods in assembling or disassembling rod strings used in a well. Thus, there is the need for an apparatus and method which would permit this.

SUMMARY OF THE INVENTION

The present invention overcomes the above-noted and other shortcomings of the prior art by providing a novel and improved adapter which is particularly suitable in its preferred embodiment for adapting a rod to be rotated by tubing tongs. The present invention also provides a method of rotating a rod relative to a string of one or more rods used in a well. Thus, the present invention broadly provides an adapter and, more specifically, an adapter for a rod used in a well, which adapter adapts the rod to be rotated by tubing tongs; the present invention also provides a related method.

The adapter of he present invention comprises: a sleeve, including a first longitudinal slot defined therein; and a door, including a second longitudinal slot defined therein, which door is movably disposed on the sleeve so that the door is movable relative to the sleeve between a first position, wherein the first and second longitudinal slots are aligned, and a second position, wherein the first and second slots are not aligned.

More specifically with reference to an adapter for a rod used in a well, which adapter adapts the rod to be rotated by tubing tongs, the adapter of the present invention comprises: adapter body means for internally receiving the rod through a passageway defined in the adapter body means and for externally receiving the tubing tongs; and door means, mounted on the adapter body means and movable relative to the adapter body means between a first position and a second position, for opening the passageway into the adapter body means when the door means is in the first position and for closing the passageway into the adapter body means when the door means is in the second position.

The method of rotating a rod relative to a string of one or more rods used in a well comprises the steps of: supporting the string of rods so that the rod to be rotated is at the top of the string above the mouth of the well; mounting an adapter on the rod to be rotated; engaging the adapter with tubing tongs; and actuating the tubing tongs to rotate the adapter and the rod on which the adapter is mounted. In a particular embodiment, the step of mounting an adapter on the rod to be rotated includes: moving an adapter body relative to the rod to be rotated so that the rod to be rotated passes through a slot in the adapter body and is received within the adapter body; and moving a member, mounted on the adapter body, relative to the adapter body until the member covers at least part of the slot to hold the rod within the adapter body.

Therefore, from the foregoing, it is a general object of the present invention to provide a novel and improved adapter and method, both of which are particularly suited in the preferred embodiment for rotating a rod relative to a rod string using tubing tongs. Other and further objects, features and advantages of the present invention will be readily apparent to those skilled in the art when the following description of the preferred embodiment is read in conjunction with the accompanying drawings.

DETAILED DESCRIPTION OF THE PREFERRED EMBODIMENT

Figure 1:
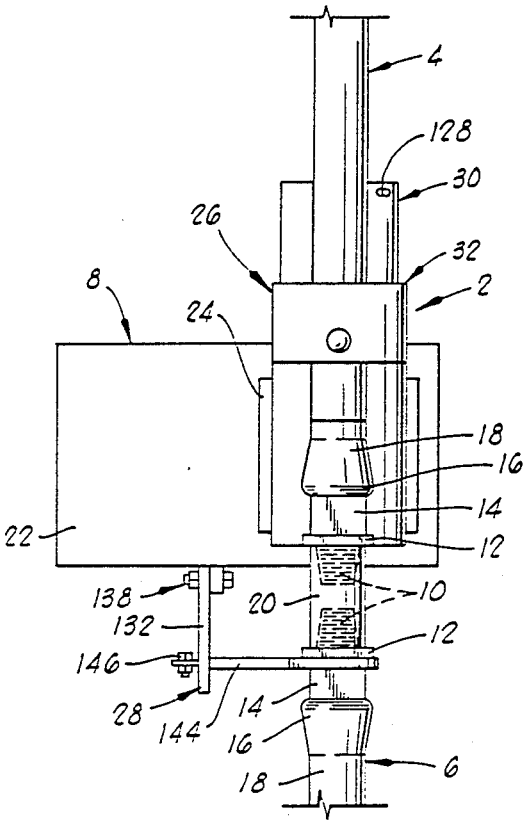
FIG. 1 is a schematic representation of the preferred embodiment adapter of the present invention shown associated with two coupled rods and tubing tongs.

Schematically depicted in FIG. 1 is an adapter 2 representing the preferred embodiment of the present invention which is more particularly illustrated in FIGS. 2—12 to which further reference will be made hereinbelow. Also illustrated in FIG. 1 is a particular environment in which the adapter 2 has particular utility. This environment includes a string of one or more rods, two coupled adjacent ones of which are identified in FIG. 1 by the reference numerals 4, 6. The adapter 2 is mounted on the rod 4 so that the rod 4 can be rotated by tubing tongs 8 which are also depicted within the environment illustrated in FIG. 1

The rods 4, 6 of the illustrated environment are conventional rods utilized in the oil and gas industry; they are sometimes referred to as sucker rods. For the orientation represented in FIG. 1, the rod 4 is located at the top of the string of rods so that the rod 6, and any additional rods, extend therebelow into a well (not shown). Ordinarily, the rod 6 or other lower portion of the rod string will be engaged by rod elevators to hold the rod string so that its upper end is held above the mouth of the well. Being so positioned, the rod 4 can be manipulated by the adapter 2 and the tubing tongs 8.

The rods 4, 6 have conventional shapes well known in the art. In particular, each rod is symmetrical in that both ends of a rod have the same shape. This shape generally includes a threaded pin end 10 extending from a radially extending shoulder portion 12. On the opposite side of the shoulder 12 from the pin end 10 is a square portion 14 adjacent which a protuberant portion 16 bulges outwardly from the square end portion 14 before tapering back into a cylindrical shaft portion 18 forming the predominant length of the rod. Because the rod 6 has the same configuration as the rod 4, the corresponding parts of the rod 6 are identified in FIG. 1 with the same reference numerals used hereinabove with reference to the rod 4.

The two coupled adjacent ends of the rods 4, 6 illustrated in FIG. 1 are shown connected by a coupling collar 20. The collar 20 is a conventional coupling member having a cylindrical shape which is internally threaded to receive the respective threaded pin ends 10 of the rods 4, 6.

As depicted in FIG. 1, the rod 4 is the rod which is to be rotated using the present invention. This rotation is relative to the lower, adjacent rod 6 and any additional rods extending below the rod 6. This rotation is to be imparted by the tubing tongs 8 which is a conventional mechanism well known in the oil and gas industry. In general, the tubing tongs 8 includes a stationary outer portion 22 which remains stationary relative to the rod 6 when the tubing tongs 8 is used with the adapter 2 to rotate the rod 4. The tubing tongs 8 also includes a rotatable inner portion 24 carried by the stationary outer portion 22. Once the adapter 2 has been implaced on the rod 4, the tubing tongs 8 is used in a conventional manner to grip or otherwise engage the adapter 2 and then impart the desired rotation by which the rod 4 is either connected to or disconnected from the rod 6.

In the preferred embodiment of the adapter 2 depicted in FIG. 1, the adapter 2 includes a rod-mountable assembly 26 and a holding assembly 28 which is connectible to the stationary outer portion 22 of the tubing tongs 8 and to the rod 6 to hold the rod 6 to prevent it from rotating when the rotatable inner portion 24 is actuated to rotate the assembly 26 and the rod 4. It is contemplated, however, that the assembly 26 of the adapter 2 is the principal part of the adapter 2 and can have utility on its own separate from being used in combination with the holding assembly 28. The preferred embodiment of the rod-mountable assembly 26 will next be described with reference to FIGS. 2–8, followed by a description of the preferred embodiment of the holding assembly 28 with reference to FIGS. 9–12.

The rod-mountable assembly 26 includes adapter body means 30 for internally receiving a rod, specifically the rod 4 for the illustration shown in FIG. 1, and for externally receiving the tubing tongs 8. The assembly 26 also includes door means 32, mounted on the adapter body means 30 and movable relative to the adapter body means 30 between a first position and a second position, for opening a passageway into the adapter body means 30 when the door means 32 is in the first position (see FIG. 2) and for closing the passageway into the adapter body means 30 when the door means 32 is in the second position (see FIG. 1 or 3).

The adapter body means 30 includes a sleeve 34. The sleeve 34 has a lower body portion 36 and an upper body portion 38 which are connected and extend collinearly between the two ends of the sleeve 34. The two body portions 36, 38 have different outer diameters so that a radial shoulder surface 40 exists at the boundary of the lower body portion 36 and the upper body portion 38. The sleeve 34 also includes a slot 42 defined between the two ends of the sleeve 34 and adapted as a passageway to pass an end of a rod therethrough.

The lower body portion 36 has an outer surface 44 defining an outer diameter of the lower body portion 36 which is greater than an outer diameter of the upper body portion 38. The outer diameter of the lower body portion 36 is such that the lower body portion 36 is adapted to be engaged by the rotatable inner portion 24 of the tubing tongs 8. The length of the lower body portion 36, and thus of the outer surface 44 is approximately seven inches in the preferred embodiment to accommodate the six-inch bite of conventional tubing tongs 8. The outer surface 44 extends longitudinally from the shoulder surface 40 and circumferentially from an edge 46 of the lower body portion 36 defining a part of the slot 42. This circumferential extension of the outer surface 44 continues circularly around the lower body portion 36 to an opposite edge 48 defining a part of the other side of the slot 42. Extending in a similar manner between the edges 46, 48 of the slot 42 is an inner surface 50 which is continuous up through the upper body portion 38.

Figure 2:
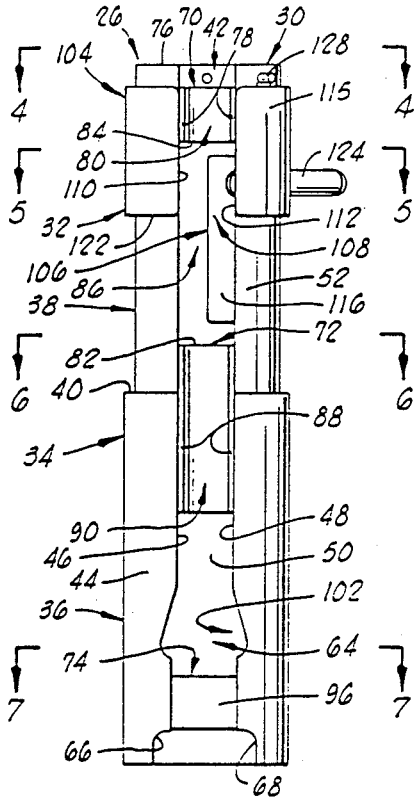
FIG. 2 is an elevational view of the preferred embodiment of the rod-mountable adapter assembly of the present invention, shown with a door of the assembly open.
Figure 3:
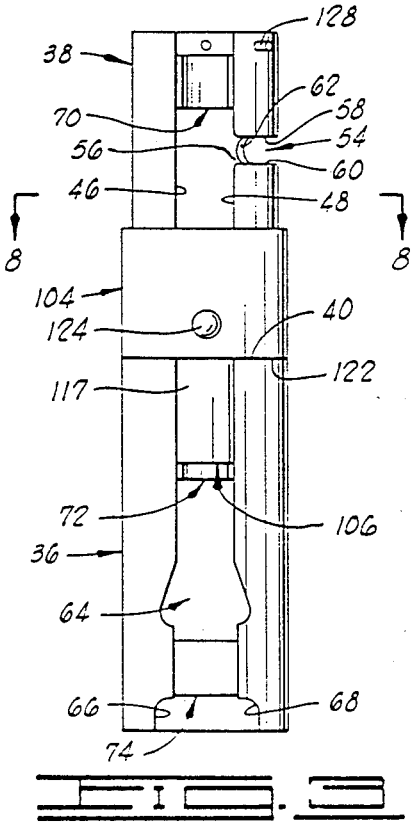
FIG. 3 is the elevational view shown in FIG. 2, but with the door closed.
Figure 4:
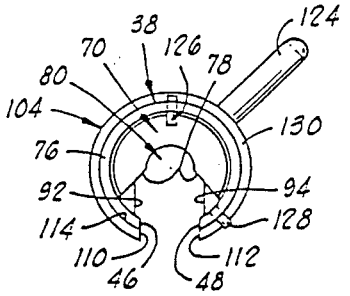
FIG. 4 is a top view of the rod-mountable adapter assembly taken along line 2—2 shown in FIG. 2.

The upper body portion 38 is adapted to receive the door means 32 about an outer surface 52 of the upper body portion 38. The outer surface 52 is inset radially inwardly relative to the outer surface 44 of the lower body portion 36; however, the outer surface 52 extends circumferentially between the edges 46, 48 of the slot 42 in the same manner as the outer surface 44 (as does the surface 40, except for it being a radial surface whereas the surfaces 44, 52 are longitudinal surfaces). The edges 46, 48 of the slot 42 extend linearly through the upper body portion 38 as shown in FIG. 2, for example. Intersecting and extending circumferentially or, more generally, laterally from the slot 42 is a slot 54 (FIG. 3) having a mouth 56 communicating with the slot 42 and further having side edges 58, 60 and end edge 62 spaced circumferentially from the mouth 56.

The slot 42 is defined longitudinally through one section of the sleeve 34 as is apparent from FIG. 2, for example. The edges 46, 48 defining the slot 42 are straight throughout most of the length of the slot 42 except near the lower end. At the lower end, the slot 42 has a bulbous aperture 64 defined by the edges 46, 48 having a curvilinear shape as shown in FIG. 2, for example. The lower extent of the bulbous aperture 64 returns to a straight slot section which continues to the lowermost extremity of the slot 42 where circumferentially extending notches 66, 68 are defined. This configuration of the slot 42 having the predominantly straight portions combined with the bulbous aperture 64 and the notches 66, 68 conform the slot 42 to the shape of the lower end of a conventional rod of the type described hereinabove and specifically identified in FIG. 1 as the rod 4. That is, the edges 46, 48 of the slot 42 are spaced and shaped sufficiently to allow an end of one of the rods described hereinabove to be received within the sleeve 34 by passing through the slot 42.

Within the inner cavity or opening defined through the sleeve 34 by the inner surface 50 are stabilizer or centralizer portions. In the preferred embodiment shown in the drawings, these portions are constructed of inserts welded or otherwise connected inside the sleeve 34. In the preferred embodiment there are an upper stabilizer member 70, a central stabilizer member 72 and a lower stabilizer member 74.

The upper stabilizer member 70 (see FIGS 2 and 4) is disposed in the upper body portion 38 at the upper end of the sleeve 34 just below a radial edge 76 of the sleeve 34. The stabilizer member 70 has a substantially annular or hollow cylindrical shape but with a longitudinal section thereof removed to define a slot or opening 78. The width of the slot or opening 78 is greater than the width of the slot 42 where the stabilizer member 70 is positioned in the preferred embodiment. The slots 78, 42 are, however, aligned in communication with each other so that when the rod 4 is received through the slot 42, it in turn is received through the slot 78 into nesting relationship within an axial, substantially cylindrical hollow center 80 of the stabilizer member 70. The position of the hollow center 80 of the stabilizer member 70 is such that the stabilizer member 70 centralizes the rod when it is received therein.

Disposed centrally within the interior cavity of the sleeve 34 is the central stabilizer member 72. An upper portion of the stabilizer member 72 is disposed in a lower part of the upper body portion 38, and a lower portion of the stabilizer member 72 extends into an upper region of the lower body portion 36 as shown in FIG. 2, for example. The stabilizer member 72 (see also FIGS. 5 and 6) is spaced from the upper stabilizer member 70 so that an upper edge 82 of the central stabilizer member 72 is spaced from a lower edge 84 of the upper stabilizer member 70. This spacing defines a partially annular space or cavity 86 within the sleeve 34 between the spaced edges 82, 84.

The shape of the central stabilizer member 72 is the same as that of the upper stabilizer member 70 except that the central stabilizer member 72 is longer. As with the upper stabilizer member 70, the central stabilizer member 72 has a longitudinal slot, identified by the reference numeral 88, which is wider than, but aligned with the slot 42 of the sleeve 34. The slot 88 of the central stabilizer member 72 also communicates with a rounded longitudinally extending opening 90 defined through the length of the central stabilizer member 72 coaxially with the upper stabilizer member 70 and the sleeve 34. This defines, as in the upper stabilizer member 70, a curved receptacle for receiving a portion of the cylindrical shaft 18 of the rod 4.

Figure 7:
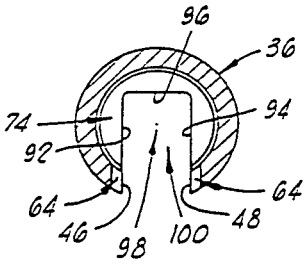
FIG. 7 is a sectional view taken along line 7—7 shown in FIG. 2.

Spaced below the central stabilizer member 72 is the lower stabilizer member 74 (see FIGS. 2 and 7). In the preferred embodiment, it is disposed in the lower body portion 36 of the sleeve 34 near the other end of the sleeve 34 opposite the end near which the upper stabilizer member 70 is disposed. Although the lower stabilizer member 74 stabilizes and centralizes the rod 4, as do the upper and central stabilizer members 70, 72, the lower stabilizer member 74 has a squared receptacle configuration which receives the square portion 14 of the rod 4. This squared receptacle for receiving this portion of the rod 4 is defined by three flat inner surfaces 92, 94, 96 wherein the surfaces 92, 94 extend perpendicularly from the innermost surface 96. This defines a chamber 98 which communicates through a mouth 100 thereof with the slot 42, with which the mouth 100 of the chamber 98 is aligned. The surfaces 92, 94, 96 in the preferred embodiment specifically extend between the upper edge of the notches 66, 68 to the lower boundary of the bulbous aperture 64, which coincides with the square portion 14 of the rod 4. The surfaces 92, 94, 96 do not extend above the bulbous aperture 64 because the volume of the hollow interior of the sleeve 34 radially inwardly from the bulbous aperture 64 and adjacent the lower stabilizer member 74 is needed to define a bulbous receptacle 102 to receive the protuberant portion 16 of the rod 4. Thus, the bulbous receptacle 102 is disposed between the curved receptacle of the central stabilizer member 72 and the squared receptacle of the lower stabilizer member 74.

As is apparent from the drawings, the various receptacles defined within the sleeve 34 for receiving respective portions of the rod 4 are aligned along the longitudinal slot 42 of the sleeve 34.

Circumferentially and longitudinally slidably disposed on the upper body portion 38 of the sleeve 34 is the door means 32. The door means 32 includes a collar 104, a retaining member 106 and means for connecting the retaining member 106 to the collar 104 so that when the door means 32 is in the aforementioned first position (exemplified by the position shown in FIG. 2), the retaining member 106 is spaced circumferentially from the slot 42 of the sleeve 34, and so that when the door means 32 is in the aforementioned second position (exemplified by the position shown in FIG. 3), the retaining member 106 overlaps the slot 42.

The collar 104 has a hollow cylindrical, or annular, shape which is open longitudinally through one section thereof, thus defining a longitudinal slot 108. This slot 108 has a width defined between edges 110, 112 which is substantially the same as the width of the upper portion of the slot 42 with which the slot 108 aligns when the door means 32 is in the aforementioned first, or open, position. The collar 104 is concentrically mounted on the outside of the upper body portion 38 of the sleeve 34 so that an inner surface 114 (see FIG. 4) of the collar 104 faces the outer surface 52 of the upper body portion 38. The inner surface 114, as well as the entire collar 104, is movable adjacent the outer surface 52 so that the collar 104 can be rotated circumferentially or slid longitudinally relative thereto. The collar 104 also includes an outer surface 115.

The retaining member 106 has a shape which is a longitudinal section of a hollow cylinder. That is, the retaining member 106 has a concave surface 116 spaced from a convex surface 117 by edges 118, 120 (see FIG. 5). The spacing between the surfaces 116, 117 is such that the retaining member 106 can move within the cavity 86 defined within the sleeve 34 between the upper and central stabilizer members 70, 72 even when a rod nests within the stabilizer members. The retaining member 106 is disposed within the cavity 86 when the door means 32 is in the open position illustrated in FIG. 2, wherein the slot 42 of the sleeve 34 and the slot 108 of the collar 104 are aligned.

Upon rotating the door means 32 to the aforementioned second, or closed, position, the retaining member 106 overlaps and aligns with the slot 42, whereas the slot 108 is no longer aligned with the slot 42 but rather lies over part of the outer surface 52 of the upper body portion 38. In the fully closed position of the preferred embodiment, the collar 104 and the retaining member 106 have also dropped or been lowered to the position illustrated in FIG. 3, wherein a lower edge 122 of the collar 104 abuts or rests on the shoulder surface 40 of the sleeve 34 and the retaining member 106 aligns with the central stabilizer member 72 to define with the central stabilizer member 72 a cylindrical enclosure around a portion of the cylindrical shaft 18 of the rod 4 (see FIG. 8).

Figure 5:
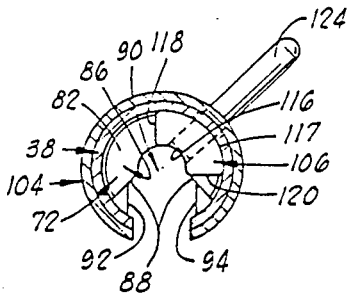
FIG. 5 is a sectional view taken along line 5—5 shown in FIG. 2.
Figure 6:
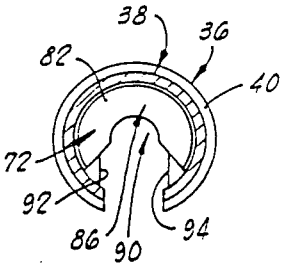
FIG. 6 is a sectional view taken along line 6—6 shown in FIG. 2.
Figure 8:
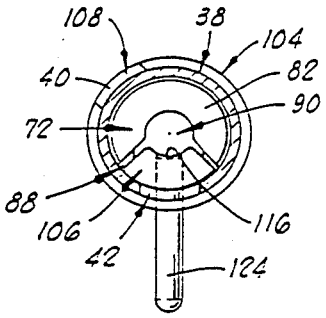
FIG. 8 is a sectional view taken along line 8—8 shown in FIG. 3.
Figure 9:
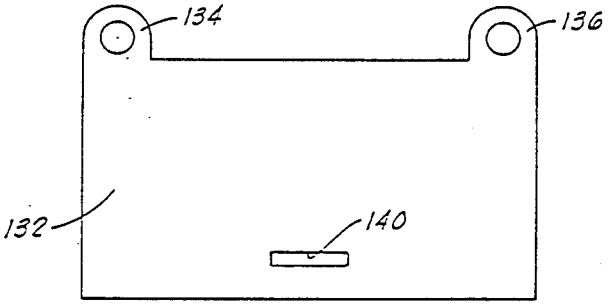
FIG. 9 is a side elevational view of a backup plate of a holding of the present invention.
Figure 10:
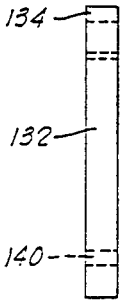
FIG. 10 is an end elevational view of the backup plate shown in FIG. 9.
Figure 11:
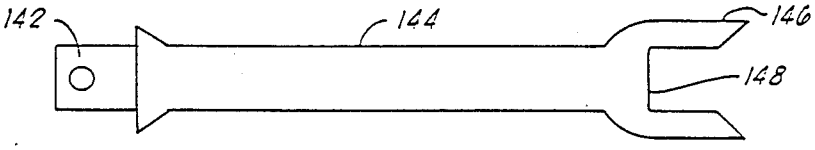
FIG. 11 is a plan view of a backup fork associated with the backup plate shown in FIGS. 9 and 10.
Figure 12:
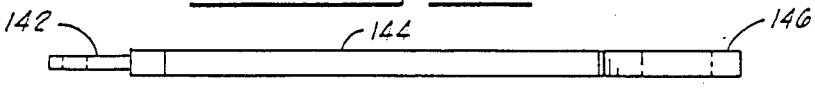
FIG. 12 an edge view of the backup fork shown in FIG. 11.

The means for connecting the retaining member 106 to the collar 104 includes a pin 124 connected between the collar 104 and the retaining member 106 so that the retaining member 106 is spaced inwardly from the collar 104 by an amount substantially equal to the thickness or distance between the inner surface 50 and the outer surface 52 of the upper body portion 38 (see FIGS. 5 and 8). The part of the pin 124 between the collar 104 and the retaining member 106 slides or rides, and is received, within the slots 42, 54 of the upper body portion 38 of the sleeve 34 as is apparent upon visualizing the movement of the door means 32 between the positions shown in FIGS. 2 and 3. Thus, the pin 124 also functions as a slide member which limits the extent of the rotational movement of the door means 32 by interacting with the edges of the slots 42, 54. The downward extent of longitudinal movement of the door means 32 relative to the sleeve 34 is, of course, limited by the shoulder surface 40 as previously described, and the upward extent of this longitudinal movement is limited by two pins 126, 128 (see FIG. 4) extending radially outwardly from the outer surface 52 of the upper body portion 38 near the upper end thereof. When the door means 32 is moved sufficiently upwardly with the pin 124 riding in the slot 42, this upward movement is stopped when an upper edge 130 of the collar 104 engages the pins 126, 128.

Referring next to FIGS. 9–12, the holding assembly 28 will be described. As previously stated, the assembly 28 is adapted to be connected to the stationary outer portion 22 of the tubing tongs 8. It is also adapted so that when it is connected to the tubing tongs 8, it can also be made to engage and hold the rod 6, for the embodiment shown in FIG. 1, against rotation when the tubing tongs 8 engage the sleeve 34 and rotate it and the rod 4 received within the sleeve 34.

The assembly 28 includes what is referred to herein as a backup, or retaining, plate 132 having a generally rectangular shape from one edge of which two apertured ears 134, 136 extend. The apertured ears 134, 136 receive nut and bolt or other suitable connectors for connecting the backup plate 132 to the tubing tongs 8 in a manner as illustrated at 138 in FIG. 1.

The backup plate 132 also includes an aperture 140 for receiving an apertured end 142 of a backup, or retaining, fork 144. After the end 142 of the fork 144 has been pushed through the aperture 140, a retaining pin 146 (FIG. 1) is inserted through the aperture of the end 142 to retain the fork 144 with the plate 132.

Opposite the end 142 of the fork 144 is a forked end 146 having a square notch 148 defined therein. The notch 148 has a width sufficient to receive the square portion 14 of the rod 6 as illustrated in FIG. 1. Sides of the square portion 14 engage the sides of the notch 148, thus preventing the rod 6, and the remainder of the rod string therebelow if any, from rotating when the rod 4 is rotated.

Although it is believed that a type of fork has been used with rod tongs to hold the lower portion of a rod string when an upper rod is being rotated by the rod tongs, the assembly 28 of the present invention further includes the backup plate 132 which is needed to adapt the fork 144 to have a suitable spacing below the tubing tongs 8 when the tubing tongs 8 engages the rod-mountable assembly 26 of the present invention in the manner illustrated in FIG. 1.

With reference to the environment illustrated in FIG. 1, the method of the present invention will be described. To rotate the rod 4 relative to the rod string including at least the rod 6, the string, and usually particularly the rod 6, is supported so that the rod 4 to be rotated is at the top of (such as either being connected thereat or held thereabove) the string above the mouth of the well in which the string is to be or has been used. Supporting the string of rods typically includes using some type of slips to engage the rod 6. It is contemplated that rod elevators which are typically available can be used to hold the rod 6 up out of the well. This support also includes connecting the retaining fork 144 to the tubing tongs 8 (in the preferred embodiment by means of the backup plate 132) and engaging with the forked end 146 the upper end of the rod 6, which is immediately below the rod 4 to be rotated. As previously described, this holds the rod 6 and the remainder, if any, of the string of rods against rotation when the tubing tongs 8 is actuated to rotate the rod 4. In the preferred embodiment this anti-rotational supporting by the fork 144 does not occur until after the rod-mountable assembly 26 has been mounted on the rod 4 and the tubing tongs 8 has been engaged with the mounted assembly 26.

With the string of rods supported so that the rod to be rotated is at the top of the string, the rod-mountable assembly 26 of the adapter 2 is mounted on the rod 4. This includes opening, or maintaining open, the door of the assembly 26 relative to the body thereof. The door is open when it is positioned as illustrated in FIG. 2, wherein the pin 124 of the door means 32 is located within the lateral slot 54, the retaining member 106 is disposed within the cavity 86 and the slot 108 of the collar 104 is aligned with the slot 42 of the sleeve 34. With the door in this open position, the adapter body is moved relative to the rod 4 so that the lower end of the rod 4 passes through the longitudinal slot 42 and nests in the stabilizer portions defined within the adapter body. The door is then moved so that it covers at least part of the slot 42 to hold the rod 4 in the adapter body. More particularly, the collar 104 is rotated, such as by grasping and pulling or pushing the end of the pin 124 radially protruding outwardly from the outer surface 115 of the collar 104. This rotation occurs relative to the adapter body and continues until the retaining member 106 is aligned with the longitudinal slot 42. In the preferred embodiment, this occurs when the pin 124 has exited the lateral slot 54 and entered the longitudinal slot 42. When this occurs, the door 32 drops, or is otherwise moved, to its downwardmost position illustrated in FIG. 3, wherein the retaining member 106 enters the slot 88 of the central stabilizer member 72 (see also FIG. 8). This forms a substantially completed cylindrical stabilizer and centralizer around a portion of the shaft 18 of the rod 4 whereby the assembly 26 is retained on the rod 4. Thus, the collar 104 and the retaining member 106 are lowered into the second, or closed, position wherein the retaining member 106 is adjacent the central stabilizer portion of the adapter body.

With the rod-mountable assembly 26 so mounted on the rod 4, the assembly 26 is engaged with the tubing tongs 8, and particularly with the rotatable inner portion 24 whose "bite" grips or otherwise engages the outer surface 44 of the lower body portion 36 of the sleeve 34.

With the aforementioned steps taken to obtain the association of elements depicted in FIG. 1, the tubing tongs 8 is actuated to rotate the rod-mountable assembly 26 and the rod 4 on which the assembly 26 is mounted. This rotation can be used to either connect the rod 4 to the rod 6 or to disconnect the rod 4 from the rod 6. The connecting or disconnecting can occur at either end of the coupling collar 20 for the environment illustrated in FIG. 1. That is, in making up a string of rods, the collar 20 can be mounted first on either the rod 4 or the rod 6; and in breaking out the rod 4 from the rod 6, the uncoupling can occur at either the upper joint between the rod 4 and the coupling collar 20 or the lower joint between the coupling collar 20 and the rod 6.

The handling of individual rods and of a string of assembled rods is performed as known to the art. In general, the handling is by means of a suitable known type of winching system by which rods and the string are raised and lowered relative to each other or relative to the well.

One modification to the above-described invention which can be beneficial in at least some applications of the invention is to have the sleeve 34 terminated immediately below where the lower stabilizer member 74 is located. That is, in the alternative preferred embodiment, there are no notches 66, 68, and there is no portion of the assembly 26 which extends below the square portion 14 of the rod 4 when this other embodiment is mounted thereon, thereby leaving the shoulder 12 of the rod 4 fully uncovered. Furthermore, it is contemplated that the adapter body can be formed out of a solid bar having its outer surface machined to yield the offset appearance shown in FIG. 2, for example, and having a center bore machined to give suitable inner diameters to receive the stabilizer members 70, 72 and to form the cavity 86 and the bulbous receptacle 102, and further having its lower end machined to form a keyway as the lower stabilizer member 74; the slots 42, 54 are also suitably machined therein.

Thus, the present invention is well adapted to carry out the objects and attain the ends and advantages mentioned above as well as those inherent therein. While a preferred embodiment of the invention has been described for the purpose of this disclosure, changes in the construction and arrangement of parts and the performance of steps can be made by those skilled in the art, which changes are encompassed within the spirit of this invention as defined by the appended claims.

What is claimed is:

1. An adapter, comprising:

a sleeve, including a first longitudinal slot defined therein; and a door, including a second longitudinal slot defined therein, said door movably disposed on said sleeve so that said door is movable relative to said sleeve between a first position, wherein said first and second longitudinal slots are aligned, and a second position, wherein said first and second slots are not aligned, said door further including:

a collar in which said second longitudinal slot is defined, said collar concentrically mounted on the outside of said sleeve;

a retaining member disposed on the inside of said sleeve; and means for connecting said retaining member to said collar so that in said first position of said door said retaining member is spaced circumferentially from said first longitudinal slot, and in said second position of said door said retaining member overlaps said first longitudinal slot.

2. An adapter as defined in claim 1, wherein said first longitudinal slot includes a bulbous aperture defined near one end of said first longitudinal slot.

3. An adapter as defined in claim 2, wherein said first longitudinal slot further includes circumferentially extending notches defined at said one end of said first longitudinal slot.

4. An adapter as defined in claim 1, wherein:

said sleeve includes:

a first outer surface extending circumferentially from one edge of said first longitudinal slot to the opposite edge of said first longitudinal slot;

a shoulder surface extending circumferentially from one edge of said first longitudinal slot to the opposite edge of said first longitudinal slot and radially from said first outer surface; and a second outer surface extending longitudinally from said shoulder surface and circumferentially from one edge of said first longitudinal slot to the opposite edge of said first longitudinal slot; and said door is disposed for movement adjacent said first outer surface.

5. An adapter as defined in claim 1, wherein said sleeve has defined therein a lateral slot extending from said first longitudinal slot, said lateral slot receiving said means for connecting when said door is in said first position.

6. An adapter as defined in claim 1 further comprising:

a first centralizer member disposed in said sleeve; and a second centralizer member disposed in said sleeve and spaced longitudinally from said first centralizer member so that a cavity is defined between said first and second centralizer members, said cavity having said retaining member of said door disposed therein when said door is in said first position.

7. An adapter as defined in claim 1, further comprising a longitudinal centralizer member, including a rounded opening defined coaxially through said centralizer member and also including a third longitudinal slot defined therein, said centralizer member retained within said sleeve so that said first and third longitudinal slots are aligned.

8. An adapter as defined in claim 7, further comprising a support member having three flat inner surfaces wherein two of said inner surfaces extend perpendicularly from the third of said inner surfaces to define within said support member a chamber having a mouth, said support member retained within said sleeve so that said mouth and said first longitudinal slot are aligned.

9. An adapter for a rod used in a well, which adapter adapts the rod to be rotated by tubing tongs, said adapter comprising:

adapter body means for internally receiving the rod through a passageway defined in said adapter body means and for externally receiving the tubing tongs, said adapter body means including:

a longitudinal slot defined therein as the passageway; and a lateral slot defined therein so that said lateral slot intersects said longitudinal slot; and door means, mounted on said adapter body means and movable relative to said adapter body means between a first position and a second position, for opening the passageway into said adapter body means when said door means is in said first position and for closing the passageway into said adapter body means when said door means is in said second position, said door means including:

a collar slidably and rotatably mounted on said adapter body means, said collar being open longitudinally through one section thereof;

a retaining member disposed inside of said adapter body means; and a pin connected between said collar and said retaining member so that said retaining member is spaced inwardly from said collar, said pin disposed for riding within said longitudinal and lateral slots.

10. An adapter as defined in claim 9, wherein said adapter body means includes:

a curved receptacle defined therein for receiving a portion of a cylindrical shaft of the rod; and a squared receptacle defined therein for receiving a square end portion of the rod.

11. An adapter as defined in claim 9 wherein said adapter body means further includes:

a stabilizer portion which engages the rod to stabilize the rod within said adapter body means; and a cavity defined therein adjacent said stabilizer portion so that said cavity receives said retaining member of said door means when said door means is in said first position.

12. An adapter for a rod used in a well, which adapter adapts the rod to be rotated by tubing tongs, said adapter comprising:

adapter body means for internally receiving the rod through a passageway defined in said adapter body means and for externally receiving the tubing tongs;

door means, mounted on said adapter body means and movable relative to said adapter body means between a first position and a second position, for opening the passageway into said adapter body means when said door means is in said first position and for closing the passageway into said adapter body means when said door means is in said second position; and said adapter body means including:

a sleeve, including a lower body portion and an upper body portion extending collinearly between two ends of said sleeve, said lower body portion having a greater outer diameter than said upper body portion so that said lower body portion is adapted to be engaged by the tubing tongs and so that said upper body portion is adapted to receive said door means, said sleeve further including the passageway thereof characterized as a slot defined therein between said two ends of said sleeve and adapted to pass an end of the rod therethrough;

an upper stabilizer member disposed in said upper body portion at one end of said sleeve, said upper stabilizer member communicating with said slot;

a central stabilizer member disposed in said sleeve in adjacent portions of said upper and lower body portions, said central stabilizer member spaced from said upper stabilizer member so that a partially annular space is defined therebetween within said sleeve, and said central stabilizer member communicating with said slot; and a lower stabilizer member disposed in said lower body portion at the other end of said sleeve, said lower stabilizer member communicating with said slot.

13. An adapter as defined in claim 12 wherein:

said upper body portion includes a lateral slot interseeting said slot defined in said sleeve between said two ends of said sleeve; and said door means includes:

a collar slidably and rotatably mounted on said upper body portion, said collar being open longitudinally through one section thereof;

a retaining member disposed within said sleeve so that said retaining member is movable between said partially annular space and a position of alignment with said slot defined in said sleeve between said two ends thereof; and a slide member connected between said collar and said retaining member and disposed for sliding within said lateral slot and said slot defined in said sleeve between said two ends thereof.

14. An adapter as defined in claim 9, further comprising holding means, adapted to be connected to the tubing tongs, for engaging and holding another rod against rotation when the tubing tongs engage said adapter body means and rotate said adapter body means and the rod received therein.

15. A method of rotating a rod relative to a string of one or more rods used in a well, said method comprising the steps of:

supporting the string of rods so that the rod to be rotated is at the top of the string above the mouth of the well;

mounting an adapter on the rod to be rotated, said step of mounting an adapter on the rod to be rotated including:

moving an adapter body relative to the rod to be rotated so that the rod to be rotated passes through a slot in the adapter body and is received within the adapter body; and moving a member, mounted on the adapter body, relative to the adapter body until the member covers at least part of the slot to hold the rod within the adapter body;

engaging the adapter with tubing tongs; and actuating the tubing tongs to rotate the adapter and the rod on which the adapter is mounted.

16. A method as defined in claim 15, wherein said step of supporting the string of rods includes connecting a retaining fork to the tubing tongs and engaging with the fork the upper end of the rod of the string of rods which is immediately below the rod to be rotated so that the string of rods is held by the fork and tubing tongs against rotation when the tubing tongs is actuated.

17. A method of rotating a rod relative to a string of one or more rods used in a well, said method comprising the steps of:

supporting the string of rods so that the rod to be rotated is at the top of the string above the mouth of the well;

mounting an adapter on the rod to be rotated, said step of mounting an adapter on the rod to be rotated including:

moving an adapter body relative to the rod to be rotated so that the lower end of the rod passes through a longitudinal slot in the adapter body and nests in a stabilizer portion of the adapter body, which longitudinal slot is conformed to the shape of the lower end of the rod to be rotated;

rotating a collar, mounted on the adapter body, relative to the adapter body until a retaining member connected to the collar is aligned with the longitudinal slot; and lowering the collar and retaining member relative to the adapter body to a position wherein the retaining member is adjacent the stabilizer portion of the adapter body;

engaging the adapter with tubing tongs; and actuating the tubing tongs to rotate the adapter and the rod on which the adapter is mounted.

* * * * *